US007183541B2

(12) United States Patent
Iwamoto

(10) Patent No.: US 7,183,541 B2
(45) Date of Patent: Feb. 27, 2007

(54) MASS SPECTROMETER

(75) Inventor: Shinichi Iwamoto, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 11/062,720

(22) Filed: Feb. 22, 2005

(65) Prior Publication Data

US 2005/0189487 A1 Sep. 1, 2005

(30) Foreign Application Priority Data

Feb. 26, 2004 (JP) ..... 2004-051586

(51) Int. Cl.
*H01J 49/42* (2006.01)
*H01J 49/00* (2006.01)

(52) U.S. Cl. ..... 250/287; 250/292; 250/281; 250/282; 250/283; 250/286

(58) Field of Classification Search ..... 250/288, 250/281, 282, 289, 292
See application file for complete search history.

(56) References Cited

U.S. PATENT DOCUMENTS 4,234,791 A 11/1980 Enke et al.
5,202,563 A 4/1993 Cotter et al.
6,390,115 B1 * 5/2002 Rohwer et al. ..... 250/288
6,888,134 B2 * 5/2005 Hashimoto et al. ..... 250/292
2004/0119015 A1 * 6/2004 Hashimoto et al. ..... 250/292
2004/0222369 A1 * 11/2004 Makarov et al. ..... 250/281
2005/0116162 A1 * 6/2005 Vestal ..... 250/287
2005/0274902 A1 * 12/2005 Weiss ..... 250/423 R

FOREIGN PATENT DOCUMENTS

JP 184349 6/2002

* cited by examiner

*Primary Examiner*—Nikita Wells
*Assistant Examiner*—Johnnie L Smith, II
(74) *Attorney, Agent, or Firm*—Rankin, Hill, Porter & Clark LLP

(57) ABSTRACT

A mass spectrometer has an ionizing portion for ionizing a sample, a mass spectrometric portion for subjecting a sample ion to mass separation and detecting the sample ion and a control portion for controlling operation of a total of the apparatus. The mass spectrometer is provided with a colliding portion provided at an ion path until a sample ion generated by the ionizing portion is introduced to amass spectrometric portion and a gas introducing portion for introducing one kind or more of gases selected from two kinds or more of gases into the colliding portion. By carrying out analysis by using the apparatus, highly accurate mass spectrometry can be carried out.

12 Claims, 3 Drawing Sheets

12
22
21
22
28
24
29a
26
27a
13
29b
27b
32

MASS SPECTROMETER

This application claims foreign priority based on Japanese patent application JP 2004-051586, filed on Feb. 26, 2004, the contents of which is incorporated herein by reference in its entirety.

BACKGROUND OF THE INVENTION

1. Field of the Invention

The present invention relates to a mass spectrometer, particularly to a mass spectrometer used for MS/MS spectrometry or $MS^n$ spectrometry.

2. Description of the Related Art

A mass spectrometer includes an ionizing portion for ionizing a sample, and a mass spectrometric portion for subjecting a sample ion to mass separation and detecting the sample ion in accordance with a mass number ([mass]/[charge number]) and the like. At the ionizing portion, the sample is ionized by an electrospray ionizing method (ESI method), an atmospheric pressure chemical ionizing method (APCI method), a matrix-assisted laser desorption ionizing (MALDI) method or the like and delivered to the mass spectrometric portion. At the mass spectrometric portion, the sample ion is separated in accordance with the mass number by a separating mechanism of a sector type, a time of flight type (TOF) or the like and respective ions are detected by a detector of a microchannel plate or the like.

Here, in considering a case of analyzing a biopolymer of protein or the like, a normal mass measurement (MS measurement) for measuring the mass number of the sample ion is effective particularly for identifying the molecule. However, in the case of analyzing a molecular structure or carrying out database search having a high accuracy, an MS/MS measurement for fragmenting (fragmentation) a specific sample ion (precursor ion) and subjecting a fragment (fragment ion) to mass separation to measure is further effective.

Fragmentation of a sample ion is carried out by making the sample ion collide with a gas (collision gas) at a colliding portion.

As the colliding portion, a collision cell, an ion trap or the like is used (refer to U.S. Pat. No. 4,234,791 and JP-A-2002-184349). In the case of a TOF type mass spectrometer, there is also a case of providing a colliding portion at a partial region in a flight tube (refer to U.S. Pat. No. 5,202,563).

In the case of a collision cell, an ion and a gas are made to collide with each other during a time period of passing a sample ion through the cell to thereby subject the ion to cleavage. In the case of an ion trap, an ion falling in a range of a specific mass number gathered to a center of the ion trap by an electric field formed within the ion trap and gas are made to be collided with each other to thereby subject the ion to cleavage. Further, in the case of a flight tube, an ion and a gas are made to collide with each other during a time period in which a sample ion passes a colliding portion to thereby subject the ion to cleavage.

As a collision gas introduced to a colliding portion, it is necessary to select a gas having a pertinent mass in accordance with an ion (precursor ion) constituting an object and an ion (fragment ion) with an object of being intended to generate by cleavage. When a number of samples are intended to analyze continuously, or when a detailed structure analysis is intended to carry out by subjecting the sample to various cleavage even in the case of one kind of a sample, it is necessary to introduce a collision gas in accordance with the object into a cell. In a related-art apparatus, there poses a problem that a swift continuous analysis cannot be carried out since time is taken in switching such a collision gas.

Further, in the case of an ion trap, when an ion is caught and subjected to cleavage, a cooling gas is introduced into an ion catching space of the ion trap at a stage of selecting and catching the ion, and a collision gas is introduced at a stage of subjecting the ion to cleavage.

However, according to the related-art apparatus, only one kind of a gas is made to be able to be introduced into the ion catching space and a common gas is used for the cooling gas and the collision gas.

The cooling gas is operated to stabilize the ion in catching and selecting the ion and in order to carry out a highly accurate mass spectrometry, in cooling, it is necessary to prevent that the sample ion collides with the gas to be subjected to cleavage. Therefore, as the cooling gas, it is preferable to use a gas having a light mass. On the other hand, the collision gas is operated to subject the ion to cleavage by colliding with the sample ion. Therefore, as the collision gas, it is preferable to use a gas having a large mass.

However, according to the gas used in the related art, the mass is excessively large for cooling, the mass is excessively small for subjecting the ion to cleavage and therefore, mass spectrometry having a sufficient accuracy cannot be carried out by the related-art apparatus. Further, the ion cannot be subjected to cleavage efficiently.

SUMMARY OF THE INVENTION

A problem to be resolved by the invention is to provide a mass spectrometer capable of carrying out highly accurate mass spectrometry by introducing a gas suitable for a kind of a sample or an object of using the gas to a colliding portion and capable of efficiently analyzing a number of samples by swiftly switching the gas.

In order to achieve the above-described object, there is provided a mass spectrometer according to the invention comprising:

an ionizing portion for ionizing a sample;

a mass spectrometric portion for subjecting a sample ion to mass separation and detecting the sample ion;

a colliding portion provided at an ion path until the sample ion generated at the ionizing portion is introduced into the mass spectrometric portion;

a selected gas introducing portion for introducing one kind or more of gases selected from two kinds or more of gases into the colliding portion; and a control portion for controlling operation of the selected gas introducing portion.

The colliding portion is introduced with a pertinent gas in accordance with an object from a plurality of kinds of previously prepared gases by the selected gas introducing portion. For example, when an ion trap is used as the colliding portion, at a stage of trapping and selecting the ion, a light gas suitable for cooling is introduced and at a stage of cleavage of the ion, a heavy gas is introduced. Meanwhile, when a collision cell or a flight tube is used as the colliding portion, a collision gas in accordance with masses, an intensity of bonding of a molecule or the like of a precursor ion and a fragment ion constituting the object is introduced.

According to the mass spectrometer of the invention, an optimum gas or a gas necessary in accordance with an ion to be analyzed can pertinently selected and introduced into the colliding portion in respective stages of a series of processings for mass spectrometry. For example, when separation and selection of ion and cleavage of ion are carried out at the ion trap, by using gases suitable for cooling and cleavage of sample ion (precursor ion), a fragment ion intensity is increased relative to a precursor ion intensity, and highly accurate mass spectrometry can be carried out. Further, by carrying out cleavage of ion by using a gas suitable for each sample, the ion can be subjected to cleavage efficiently. Meanwhile, even when an apparatus having a colliding portion other than the ion trap is used, by pertinently selecting a gas suitable for each sample, the ion can efficiently be subjected to cleavage.

Further, since different kinds of gases can swiftly be switched and therefore, when a plurality of samples using different kinds of gases need to be analyzed continuously, an efficiency of analysis is considerably increased.

BRIEF DESCRIPTION OF THE DRAWINGS

FIG. 2(*a*) shows a step of introducing a cooling gas into an ion trap. FIG. 2(*b*) shows a step of ionizing a sample and introducing an ion into the ion trap. FIG. 2(*c*) shows a step of selecting a precursor ion. FIG. 2(*d*) shows a step of introducing a collision gas into the ion trap. FIG. 2(*e*) shows a step of generating a fragment ion. FIG. 2(*f*) shows a step of separating and detecting a fragment ion.

FIG. 3(*a*) shows a case of using He gas as a cooling gas. FIG. 3(*b*) shows a case of using Ar as the cooling gas.

DETAILED DESCRIPTION OF THE INVENTION

Figure 1:
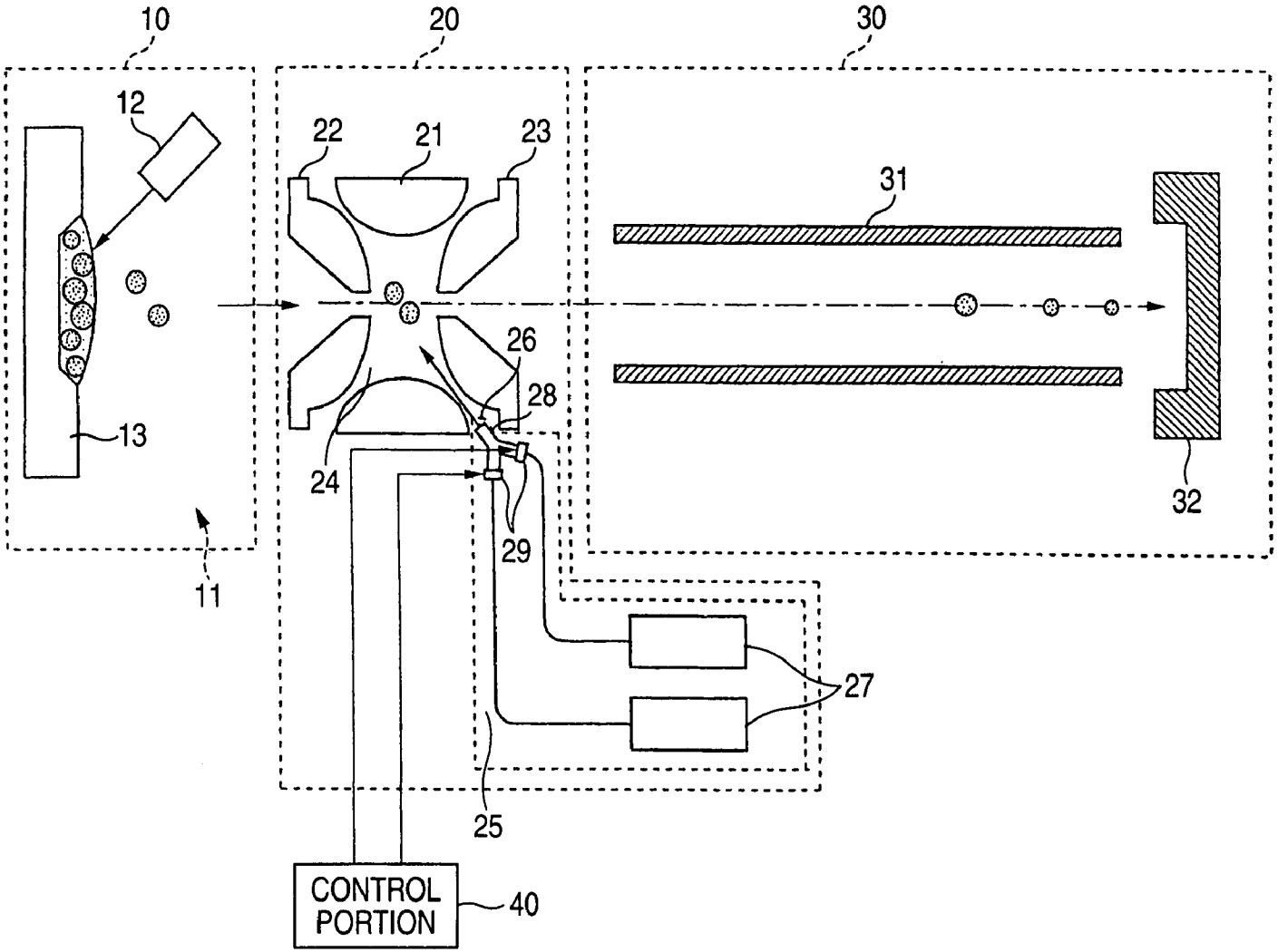
FIG. 1 is an outline constitution view of an essential portion of MALDI-QIT-TOF-MS according to an embodiment of the invention.

FIG. 1 is an outline constitution view of a MALDI-QIT-TOF mass spectrometer according to an embodiment of the invention. The mass spectrometer of the embodiment includes an MALDI type ionizing portion 10, an ion trap (QIT) 20, a TOF mass spectrometric portion 30, and a control portion 40. The MALDI type ionizing portion 10 ionizes a sample. The ion trap (QIT) 20 carries out trapping, selection and cleavage of an ion. The TOE mass spectrometric portion 30 subjects ions subjected to cleavage by the ion trap 20 to mass separation and detects respective ions. The control portion 40 controls operation of the mass spectrometer.

The ionizing portion 10 comprises an ionizing chamber 11 and a light irradiating portion 12 provided therein, a sample slide 13 for mounting a sample matrix. At the ionizing portion 10, laser light having a predetermined wave length is irradiated from the light irradiating portion 12 to the sample matrix mounted to the sample slide 13 and the sample is ionized by matrix-assisted laser desorption ionization (MALDI).

The ion trap 20 comprises a single ring electrode 21 and end cap electrodes 22, 23 arranged on both sides of the ring electrode 21 to be opposed to each other by interposing the ring electrode 21. When a high frequency voltage is applied to the ring electrode 21, a quadruple electric field is formed in a space (ion trapping space) 24 surrounded by the electrodes 21, 22, 23 to thereby trap an ion to inside of the space.

The ion trap 20 is connected with a gas introducing device 25. The gas introducing device 25 comprises a gas branch pipe 28, two pieces of gas supply sources 27, gas pipes, and pulse gas valves 29. The gas branch pipe 28 has a gas introducing port 26 at the ion trapping space 24. The gas pipes connects the respective gas supply sources 27 and respective branch ports of the gas branch pipe 28. The pulse gas valves 29 are provided at the respective branch ports of the gas branch pipe 28. Further, although according to the embodiment, the branch pipe is used as the gas branch pipe 28 and only two kinds of the sources of supplying introduced gases are provided, naturally, an arbitrary gas may be selected from three kinds or more of gases by using three kinds or more of the supply sources and using a branch pipe in accordance therewith. Further, gas introducing ports 26 for introducing an ion into an ion trapping space 24 may separately be provided for the respective gas supply sources 27 and respective gases may be introduced into the ion trapping space 24 independently from each other. Further, although it is preferable to provide the pulse gas valves at the respective branch ports from a view point of being able to finely control timings of introducing gases and introducing time or the like, a needle gas valve may be provided in place of the pulse gas valve. According to the pulse gas valve, an amount of gas that is introduced is controlled by a length of a time period of opening the valve and according to the needle gas valve, the amount of gas that is introduced is controlled by a degree of opening the valve.

The control portion 40 is provided with an operating portion (keyboard, mouth or the like) for inputting conditions of a kind of an introducing gas, a mixing ratio, introducing time or the like by an operator (not illustrated). The control portion 40 controls operation of the mass spectrometer in accordance with the conditions inputted to the operating portion.

Figure 2:
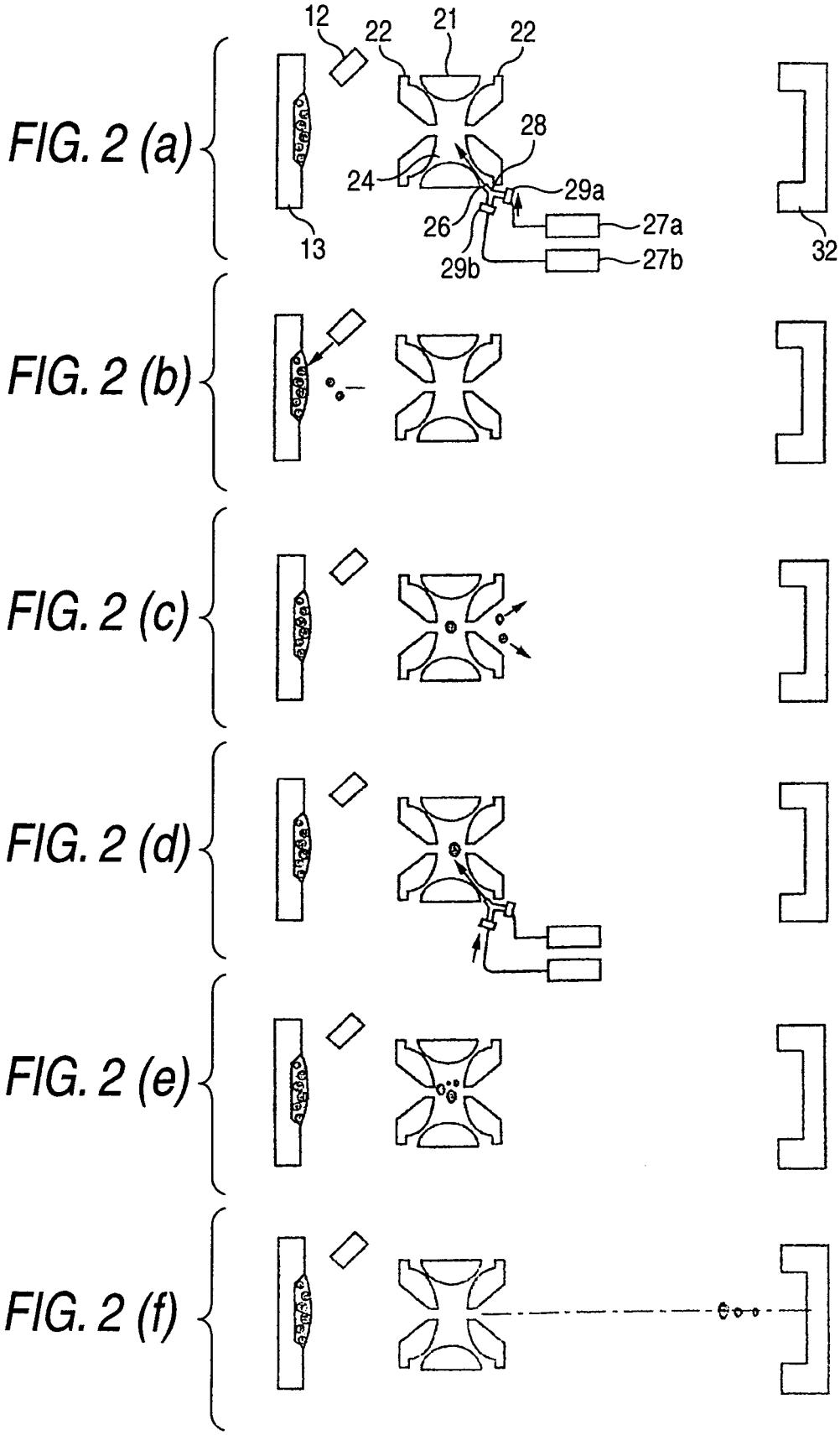
FIGS. 2(*a*)–2(*f*) illustrate schematic views representing a measurement sequence using the apparatus of the embodiment.

A sequence of MS/MS analysis which is carried out by using the mass spectrometer of the embodiment will be described below (FIG. 2).

(a) Step of Introducing Cooling Gas to Ion Trap

First, a cooling gas is introduced into the ion trapping space 24 of the ion trap 20 by the gas introducing device 25 for a short period of time (in a pulse-like shape). As the cooling gas, a gas having a small mass such as He or a nitrogen gas is preferable. The time period of introducing the gas to the colliding portion is constituted by a very short pulse-like shape of 80μs through 300ms in order to prevent the gas from staying at the colliding portion for a long period of time and causing undesirable cleavage of an ion or the like. Time of starting to introduce the cooling gas is calculated by time of irradiating laser light to the sample matrix mounted to the sample slide 13 by the control portion 40 and gases having previously set kinds and mixing ratios are introduced to the colliding portion for a previously set time period.

(b) Step of Ionizing Sample and Introducing Ion into Ion Trap

Next, similar to the normal MALDI method, laser light is irradiated to the sample matrix by a predetermined intensity to ionize the sample. The sample ion generated by irradiating laser is introduced into the ion trap 20 and is trapped into the ion trapping space 24. Here, only ions falling in a range of specific mass numbers are gathered to a center of the ion trap by operation of the quadruple electric field and the cooling gas.

(c) Step of Selecting Precursor Ion

By applying a pertinent voltage to the electrode of the ion trap 20, only a molecule ion (precursor ion) having a mass number intended to subject to MS/MS analysis is left in the ion trapping space 24 and the other ions are exhausted to outside of the ion trapping space 24.

(d) Step of Introducing Collision Gas into Ion Trap

At this occasion, the collision gas of Ar gas or the like is introduced into the ion trapping space 24 by the gas introducing device 25. Also the collision gas is introduced in a pulse-like shape by a short period of time (for example, about 100μs) by opening and closing the pulse gas valve 29*b*. Although it is necessary to pertinently select the kind of the collision gas in accordance with the mass number of the sample or the like, an inert gas having a large mass such as Ne, Kr, Xe may be preferable other than Ar.

(e) Step of Generating Fragment Ion

The sample ion trapped in the ion trapping space 24 is subjected to cleavage by oscillating the sample ion therein and making the sample ion collide with the Ar gas.

(f) Step of Separating and Detecting Fragment Ion

The ion subjected to cleavage by colliding with the Ar gas is introduced into the mass spectrometric portion 30, and the ion is separated in accordance with a mass number by a TOF type mass separation part 31 and detected the generated ion by a detector 32 to thereby obtain a mass spectrum.

Figure 3:
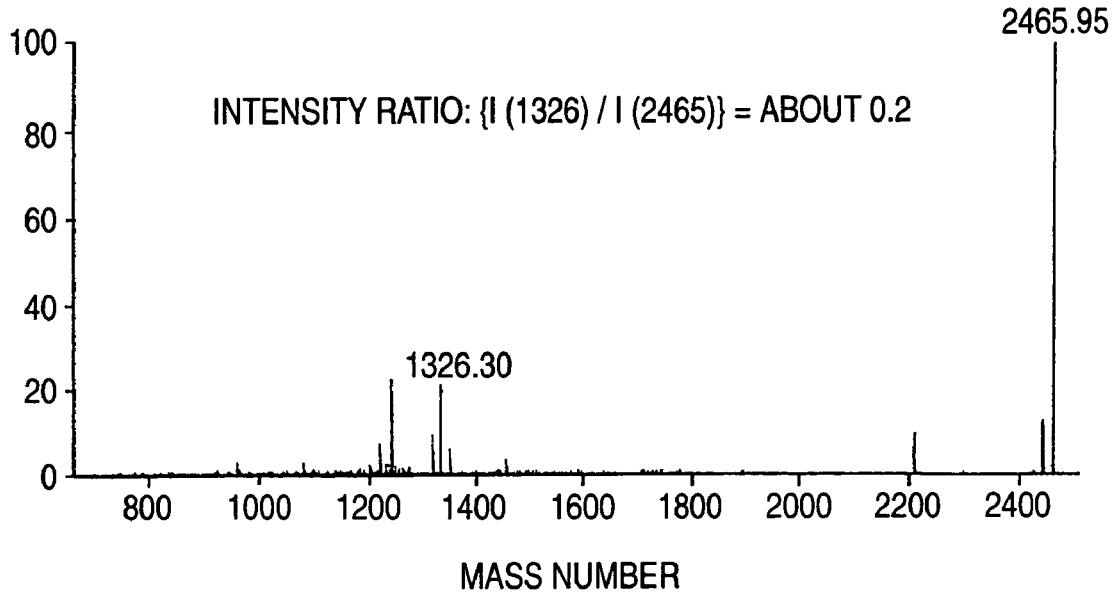
FIGS. 3(*a*)–3(*b*) show mass spectra of adrenocoriticotropic hormone 18–39 (ACTH18–39).
Figure 3:
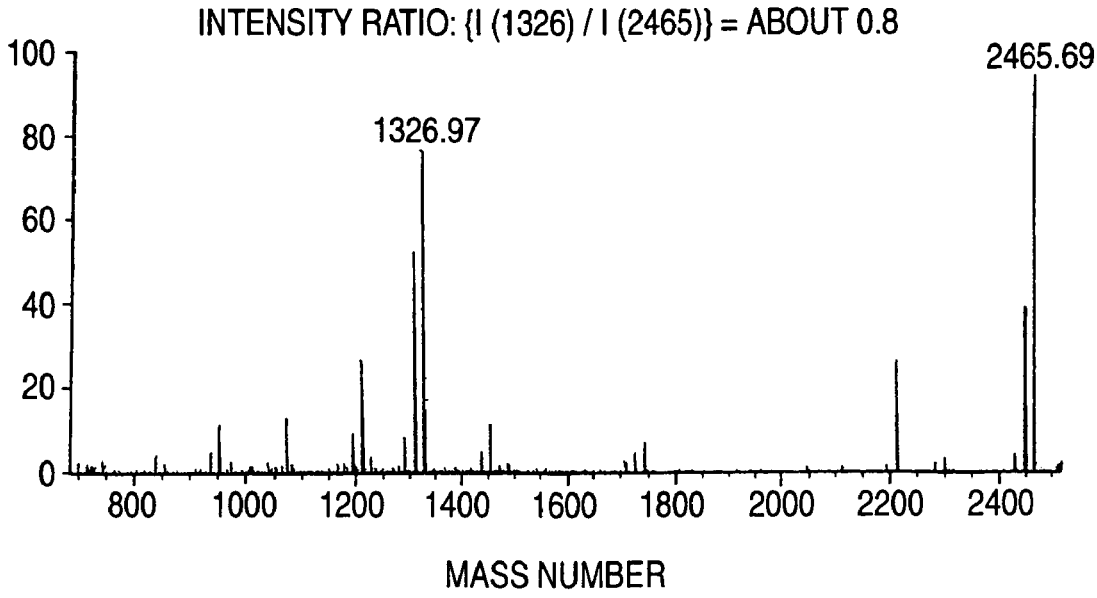

There is carried out mass spectrometry of a chain of 18-th through 39-th amino acids (ACTHI 8–39) from N terminal side of adrenocoriticotropic hormone molecule which is polypeptide comprising 39 pieces of amino acids. Mass spectra provided by the analysis are shown in FIG. 3(*a*) and FIG. 3(*b*). FIG. 3(*a*) and FIG. 3 (*b*) differ from each other only in the kind of cooling gas introduced into the ion trapping space 24. The other measurement conditions are quite the same. In FIG. 3(*a*). He gas having a light mass is used as the cooling gas and in FIG. 3(*b*), Ar gas is used as a cooling gas and a collision gas. In the related art, Ar gas is used as the cooling gas.

As a result of measurement, whereas a nominal mass number $[M+H]^+$ ion of ACTH18–39 (precursor ion) is 2465, in FIG. 3(*b*) in which measurement is carried out by using the related-art apparatus, not only precursor ion but also fragment ion peak generated by colliding with Ar gas in cooling is strongly detected, and an intensity ratio ([fragment ion intensity]/[precursor ion intensity]) of the fragment ion and the precursor ion is indicated to be 0.8. Meanwhile, in FIG. 3 (*a*) in which measurement is carried out by using the apparatus of the embodiment, the precursor ion peak of 2465 is predominately observed and it is shown that cleavage of ion is hardly brought about in cooling such that [fragment ion intensity]/[precursor ion intensity] is 0.2. The fact shows that when the fragment ion is provided by introducing the collision gas of Ar gas or the like after cooling, by using the apparatus of the embodiment, a further excellent MS/MS spectrum is provided.

It is known from the above-described that a highly accurate analysis can be carried out by properly using gases respectively suitable to cooling and cleavage of ion by using the apparatus of the embodiment. Thereby, analysis of a constitution of a sample, a molecule structure or the like can be carried out easily.

According to the above-described, a description has been given of the mass spectrometer (MALDI-QII-TOF-MS) having the matrix-assisted laser desorption ionizing device at the ionizing portion 10, carrying out trapping and selection and cleavage of an ion by using the ion trap 20 and carrying out mass separation of the ion by the time of flight type mass separation part 31. However, the device used for ionizing and mass separation or the like are not limited to those and constitutions of the device can pertinently be changed in accordance with the kind of the sample or the like. For example, in analyzing a liquid sample, in place of the matrix-assisted laser desorption ionizing device, there may be provided an electrospray ionizing device for ionizing a sample by electrostatically spraying the sample in an ionizing chamber under an atmospheric pressure.

What is claimed is:

1. A mass spectrometer comprising:

an ionizing portion for ionizing a sample;

a mass spectrometric portion for subjecting a sample ion to mass separation and detecting the sample ion;

a colliding portion provided at an ion path until the sample ion generated at the ionizing portion is introduced into the mass spectrometric portion;

a selected gas introducing portion for selectively introducing a first gas and a second gas, which are selected from two kinds or more of gases, into the colliding portion; and a control portion for controlling operation of the selected gas introducing portion.

2. The mass spectrometer according to claim 1, wherein the colliding portion is an ion trap, further wherein the first gas is a cooling gas and the second gas is a colliding gas.

3. The mass spectrometer according to claim 1, wherein the colliding portion is a collision cell.

4. The mass spectrometer according to claim 1, wherein said mass spectrometer is a time of flight type mass spectrometer, wherein the colliding portion is provided in a flight tube.

5. The mass spectrometer according to claim 1, wherein the selected gas introducing portion includes at least two gas supply sources, and wherein a pulse gas valve is provided in a gas path extending from each of the gas supply sources to the colliding portion.

6. The mass spectrometer according to claim 1, wherein the ionizing portion includes a device for ionizing the sample by irradiating laser light to the sample mixed with a matrix.

7. The mass spectrometer according to claim 1, wherein the ionizing portion includes a device for ionizing the sample by electrostatically spraying a liquid sample into an ionizing chamber under an atmospheric pressure.

8. The mass spectrometer according to claim 1, wherein the mass spectrometric portion includes a filter for subjecting the ion to mass separation by a difference in time of flight.

9. The mass spectrometer according to claim 1, wherein the first gas is a cooling gas and the second gas is a colliding gas and wherein the selected gas introducing portion includes a cooling gas supply source, a colliding gas supply source, a first gas valve that receives cooling gas from the cooling gas supply source, a second gas valve that receives colliding gas from the colliding gas supply source, at least one port that selectively receives gas output from said first and second gas valves and through which gas is delivered to said colliding portion.

10. The mass spectrometer according to claim 9, wherein a single port receives gas output from the first and second gas valves, and wherein a gas branch pipe leads to the single port.

11. The mass spectrometer according to claim 10, wherein the first and second gas valves are pulse gas valves and are provided at first and second branch ports of the gas branch pipe.

12. The mass spectrometer according to claim 2, wherein the control portion controls operation of the selected gas introducing portion such that a predetermined amount of said cooling gas is introduced into said colliding portion beginning at a time based upon operation of said ionizing portion and such that, after discontinuation of introduction of said cooling gas into said colliding portion, said colliding gas is subsequently introduced into said colliding portion.

* * * * *